US005080007A

United States Patent [19]

Maheu

[11] Patent Number: 5,080,007

[45] Date of Patent: Jan. 14, 1992

[54] TILTED SEAMLESS VENT AND METHOD FOR MAKING THE SAME

[76] Inventor: Claude E. Maheu, 12059, Lamoureux, Montreal-North, Quebec H1G 5N3, Canada

[21] Appl. No.: 478,421

[22] Filed: Feb. 12, 1990

[51] Int. Cl.[5] ..... F24F 7/02

[52] U.S. Cl. ..... 454/254; 285/43; 454/366

[58] Field of Search ..... 98/42.22, 122; 285/42, 285/43

[56] References Cited

U.S. PATENT DOCUMENTS

| | | | |
|---|---|---|---|
| 506,930 | 10/1893 | Nies et al. | 285/43 |
| 1,258,884 | 3/1918 | Fife | 285/43 X |
| 1,464,406 | 8/1923 | Butler | 285/43 |
| 1,511,884 | 10/1924 | Heppes | 285/43 |
| 1,615,929 | 2/1927 | Buckles et al. | 285/43 |
| 2,277,982 | 3/1942 | Hosbein | 98/122 X |
| 4,160,347 | 7/1979 | Logsdon | 285/42 |
| 4,386,488 | 6/1983 | Gibbs | 98/122 X |

FOREIGN PATENT DOCUMENTS

| | | | |
|---|---|---|---|
| 881850 | 9/1971 | Canada | 98/122 |
| 1218490 | 1/1971 | United Kingdom | 98/122 |

*Primary Examiner*—Harold Joyce
*Attorney, Agent, or Firm*—Roland L. Morneau

[57] ABSTRACT

A method for making seamless tilted vent comprises the spinning of a mold and a metal sheet to form a tubular member and a flat angular shackle continuously extending from and around the tubular member. The mold is made of a cylindrical member and a flat collar surrounding the cylindrical member at one end. The collar is agularly disposed relative to the cylindrical member and the metal sheet is tightened in abutting relationship against the other end of the cylindrical member. The spinning takes place about an axis corresponding to the longitudinal axis of the cylindrical member. The chasing operation of the metal against the cylindrical member is made until the metal sheet reaches the intersection of the cylindrical member with the collar to form a tubular member. The speed of the mold and of the tubular member is then set between a maximum speed not exceeding 400 RPM and short intervals of speed substantially reduced from said maximum speed. During the above sequence of speed, the metal sheet is alternatively chased until it abuts against the collar for forming the angularly disposed shackle.

5 Claims, 3 Drawing Sheets

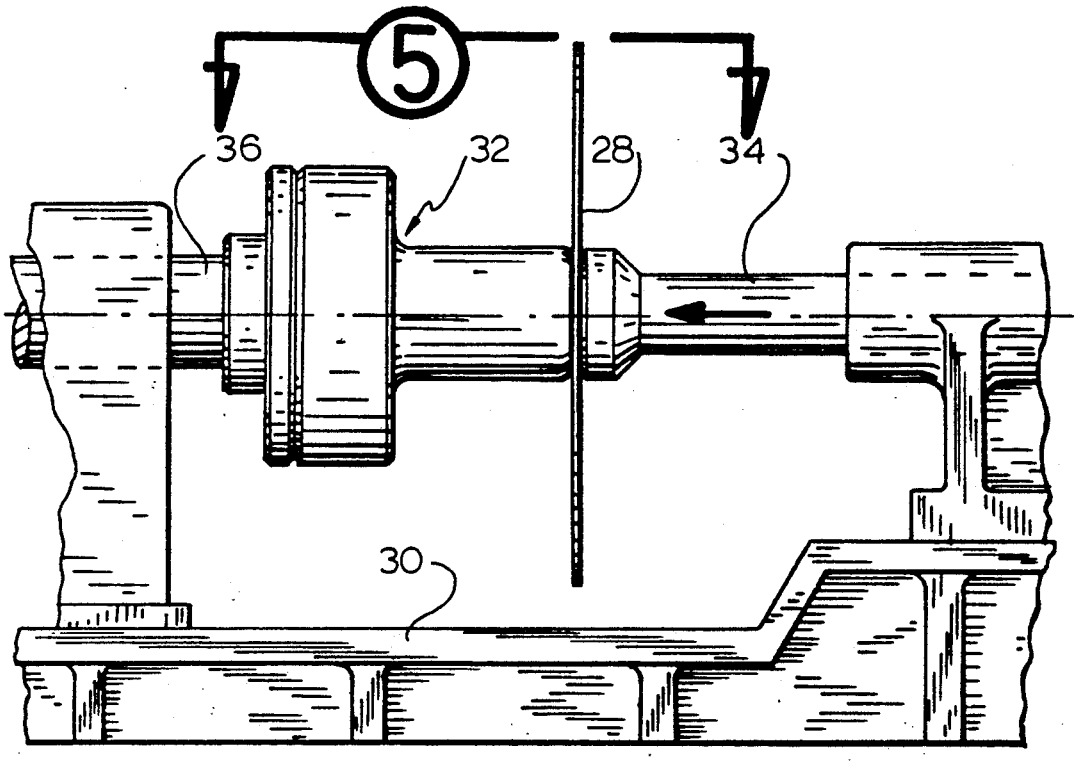
Fig.4
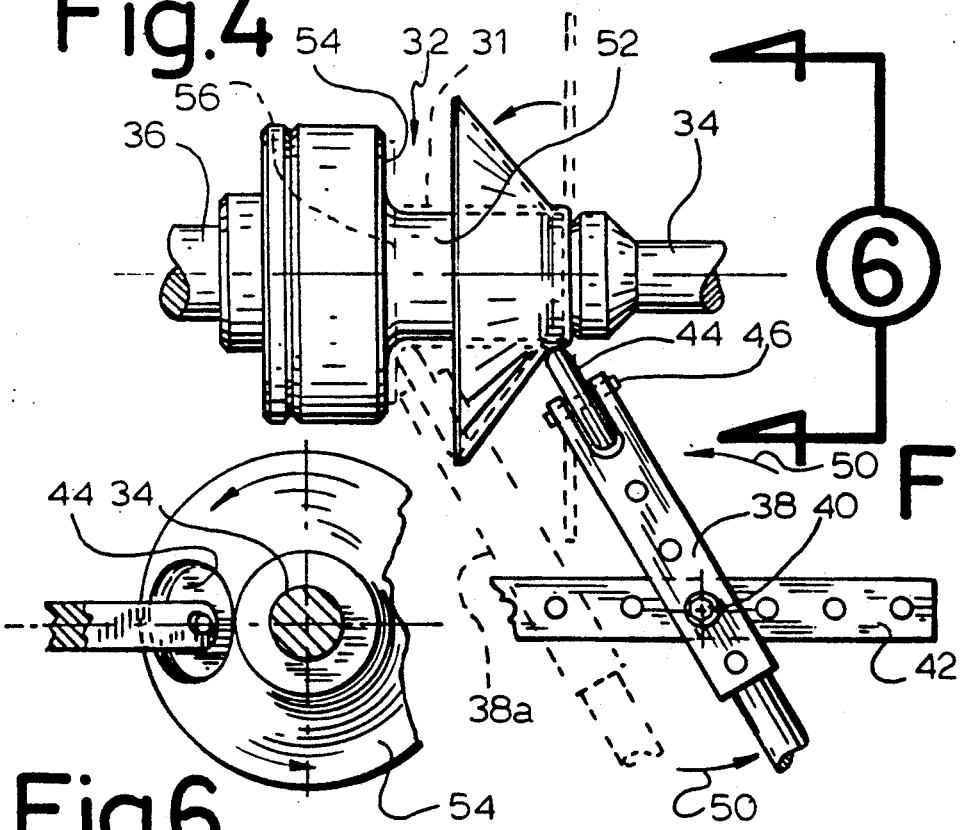
Fig.5
Fig.6

4/9

4/9

TILTED SEAMLESS VENT AND METHOD FOR MAKING THE SAME

BACKGROUND OF THE INVENTION

Roof vents which are presently made for sloping roofs are made of a tubular pipe cut at an angle and welded to a flat ring, the angle of the pipe corresponding to the angle of the sloping roof. Such method of constructing roof vents usually leads to vents which are leaking around the soldered parts and accordingly, does not provide satisfactory results. Furthermore, this method of producing tilted vents requires many operations which raises the cost of the final product.

In U.S. Pat. No. 4,214,513, issued on July 29, 1980, Ballard et al. describes a one-piece roof vent device and methods of constructing and utilizing the same. Although, this vent device is made out of one piece, its construction is symetrical relative to the vertical axis of the vent. This vent device is also intended for flat roofs and the method can not be concieved to be built on an annular base portion tilted relative to the longitudinal axis of the vent device.

FIELD OF THE INVENTION

The present invention is directed to a one-piece roof vent device which has an annular base portion angularly disposed relative to the axis of the vent.

The invention is particularly directed to a method of producing such a one-piece roof vent starting with a flat sheet of metal which is spinned according to a novel method.

The problem, which had not been solved in the past, was to produce an annular flange, tilted relative to and continously with the tubular part of the vent. The novel method makes use of a mold having a tilted collar a substantially slow spinning lathe and a chasing roller which is alternatively used in synchronism with alternate reduced speeds of the mold.

SUMMARY OF THE INVENTION

The method for making seamless tilted vents having a tubular member and a flat angular shackle which continuously extends from and around the tubular member, comprises the use of a mold having a cylindrical member and a flat collar surrounding said cylindrical member at one end thereof, the collar being angularly disposed relative to the cylindrical member. A sheet of metal which is intended to be shaped as the tilted vent is abutted against the other end of the cylindrical member. The mold and the metal sheet are spun about an axis corresponding to the longitudinal axis of the cylindrical member.

First, the sheet metal is chased against the cylindrical member until the metal sheet reaches the intersection of the cylindrical member with the collar which forms the tubular part of the vent.

At that stage, the speed of the spinning action is reduced to a maximum speed not exceeding 400 RPM and that maximum speed is substantially reduced speed during short intervals. During the short intervals, the metal is chased against the collar for forming the shackle part of the tilted vent.

Considering that the speed of spinning for chasing metal is usually above 2500 RPM, the use of a drastically reduced speed of 400 RPM is new and not obvious. Furthermore, the alternate reduction of the speed of 400 RPM allows the roller to chase the metal which needs to be drawn further against the angularly disposed collar of the mold.

The alternate reduction of the speed of the mold, on a lathe, which is electrically actuated, is obtained by alternately cutting the electrical power actuating the lathe.

BRIEF DESCRIPTION OF THE DRAWINGS

FIG. 4 is side view of a lathe supporting a sheet of metal to be chased on a mold;

FIG. 5 is a top view along arrows 6 of FIG. 4 showing the initial operation of chasing a sheet of metal over a mold;

FIG. 6 is a end view along arrows 6 shown in FIG. 5;

DETAILED DESCRIPTION OF THE INVENTION

Figure 1:
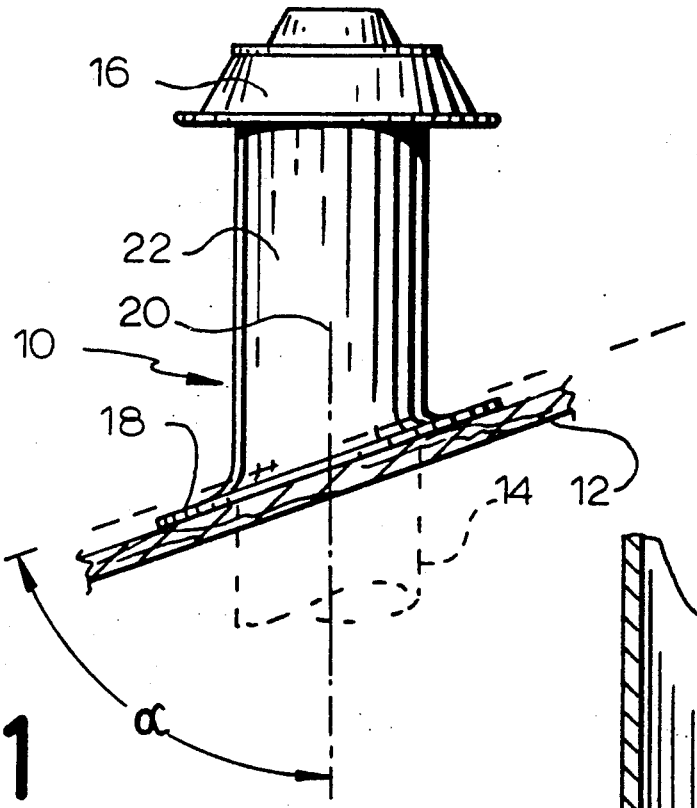
FIG. 1 is a side view of a seamless tilted vent according to the invention mounted on a portion of a roof and provided with a cover.
Figure 2:
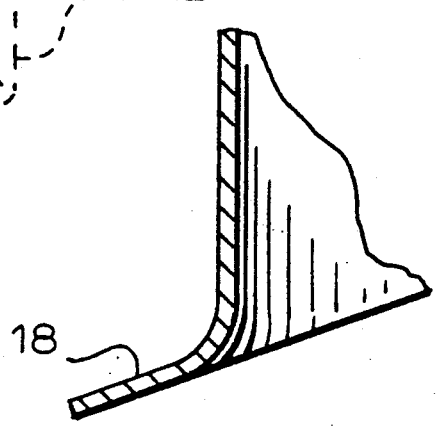
FIG. 2 is an enlarged cross-section of a portion of the vent at the intersection of the tubular member and the shackle.

FIG. 1 illustrates a tilted vent 10 according to the invention mounted on a sloping roof 12 over a venting pipe 14. A cover 16 is dispoed over the vent 10 as a protection against snow, rain or the like.

The vent 10 is considered to be tilted because the shackle 18 is set at an angle relative to the longitudinal axis 20 of the vent 10. The angle between the axis 20 and the shackle 18 corresponds to the angle of inclination of the roof 12. The vertical sleeve 22 of the vent 10 has a tubular shape which is generally cylindrical to fit over the vent pipe 14. The shackle may be provided with apertures 24 for fixing the vent on the roof with nails.

The tubular sleeve 22 is integrally made in one part with the shackle 18 so that no welding is needed as known up to know in the prior art. Shackles which are integrally made with the vertical body, up to now, are perpendicular with the axis of the tubular body. The procedure which is used to make right angle shackles cannot lead to the making of a shackle which is angularly disposed with the tubular body.

FIG. 4 illustrates the first step which leads to the production of a tilted vent. A substantially circular plate 28 is tightly mounted on a lathe 30 between a mold 32 and a poppet-head 34. The mold 32 and the plate 28 are simultaneously rotated by the spindle 36 generally actuated by an electric motor. The chasing arm 38 pivotably mounted about an axle 40 on a stationary bar 42 has a chasing roller 44 rotatably mounted about an axle 46. By pivoting the arm 38 in the direction of the arrow 50, the chasing roller 44 is applied against the surface of the plate 28 to follow the shape of the mold 32.

Figure 3:
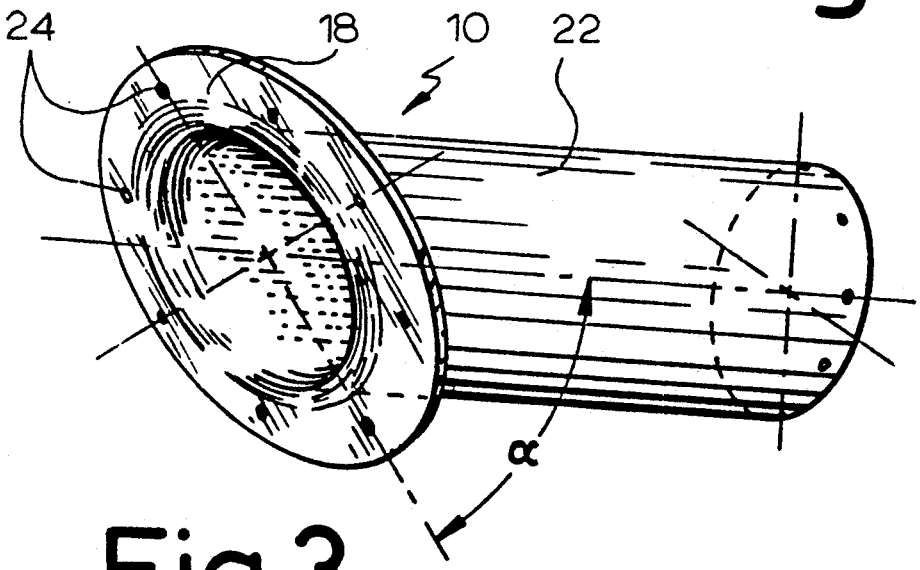
FIG. 3 is a bottom perspective view of the vent according to the invention.

At first, the plate follows the shape of the cylindrical body 52 to form a tubular sleeve as identified by 22 in FIG. 3. A lathe for producing such a tubular sleeve is set to rotate at a speed of about 2500 RPM. At that speed, it is possible to chase the metal of the plate 28 until it reaches the face 54 of the mold 32. To reach the plate 54, the roller 44 needs to be rotated about the axle 40 but the whole arm 38 needs to move sideways on the bar 42 as shown by the arm 38*a* in dotted lines in FIG. 5.

At that stage of the process, a shackle 56 shown in dotted lines is formed to reach a plane perpendicular to the axis of the body 52. A vent 31 having such a shape corresponds to the ones which are set on a flat horizontal roof. This shape is reached on a fast spinning lathe and accordingly can be produced quickly.

Figures 7, 8, 9:
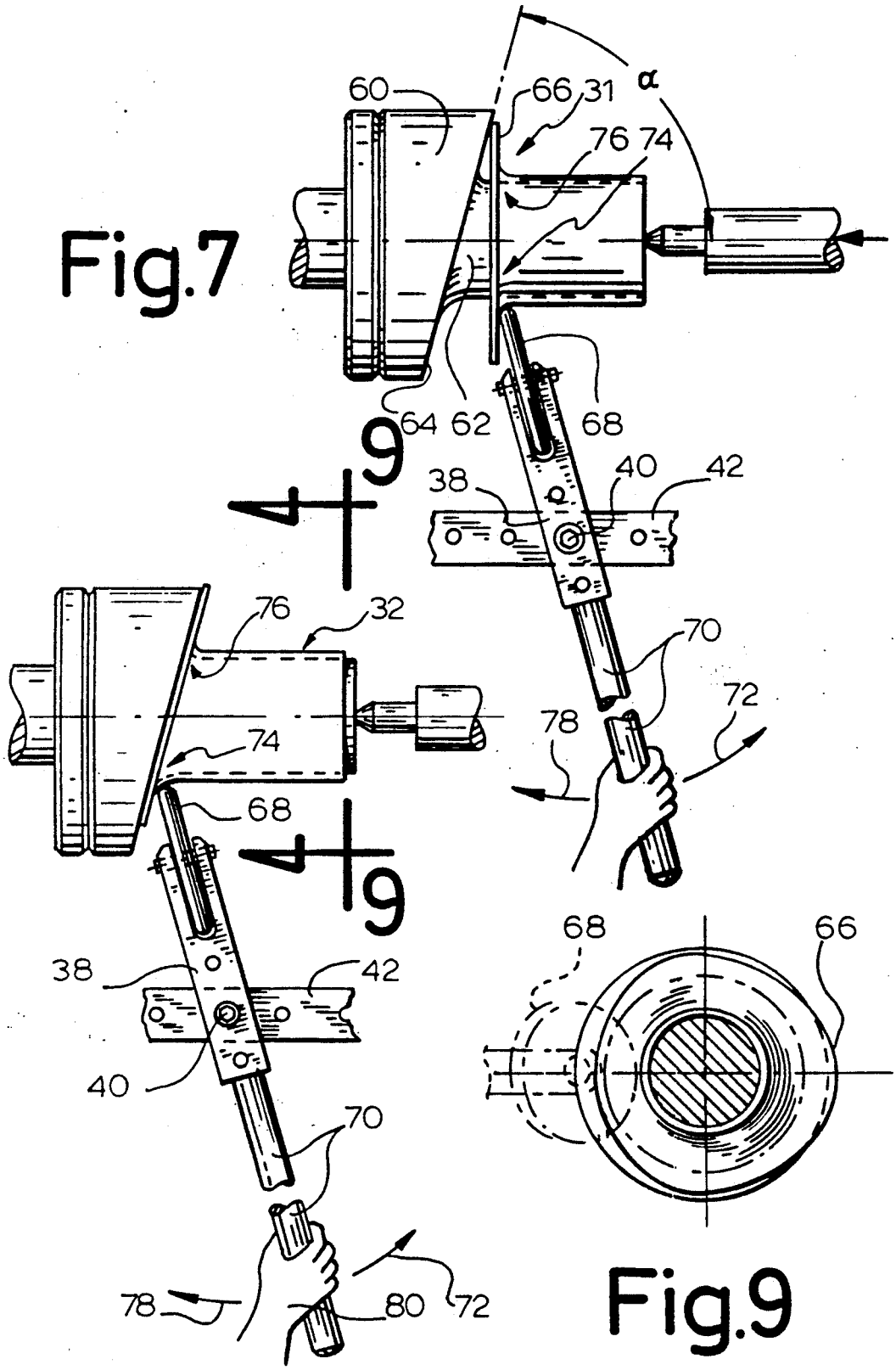
FIG. 7 is a side view of a vent mounted on a mold illustrating a subsequent operation for chasing metal around a mold having a tilted collar.
FIG. 8 is a side view as shown in FIG. 7 at the end of the chasing operation along the collar of the mold; and, FIG. 9 is a end view along arrows 9 shown in FIG. 8.

The vent 31 is then moved over an another mold 60 as shown in FIG. 7 mounted on a substantially slow rotating lathe. Such a lathe has a maximum speed of 400 RPM and can preferably operate at a suitable speed of about 200 RPM. The mold 60 used for this operation has a cylindrical body 62 and an angularly disposed flat collar 64. The vent 31 is slidden over the cylindrical body 62 until the flange 66 abuts against the collar 64.

The lathe is set into a rotating motion to reach a speed of about 200 RPM. The rotation of the lathe is obtained by an electric motor which is provided with a switch which can stop and start the rotation of the lathe at will or according to a synchronized frequency. The switch stops and starts the rotation of the lathe according to the desired location of pressure which needs to be applied against the flange 66 relative to the contour of the collar 64.

As shown in FIG. 7, the roller applies a pressure against the flange 66 when the arm 70 is pushed in the direction of the arrow 72. This pressure is allowed to take place when the roller is in contact with the radial portion of the flange 66 adjacent position 74, and the adjacent radial positions adjacent 74. However, the roller 68 needs to be retracted by pulling the bar 70 in the direction of the arrow 78 when the roller 68 reaches the radial position 76 of the mold 60.

This alternate movement is more obvious when the roller 68 reaches the position shown in FIG. 8. The roller 68 will chase the metal of the vent 33 shown in FIG. 8 when contacting the angular position 74 but will quickly need to be withdrawn from that position when the angular position 76 has come in contact with the roller 68.

In order to allow the hand 80 to manage the alternate movement in the direction of the arrows 72 and 78 and still maintain the vent at a rotating speed sufficient to chase the metal, the rotating speed will be alternately reduced from the usual speed of the lathe. While the motor of the lathe is set for a rotating speed of about 200 RPM, the current is switched off at a definite sequence for allowing the roller to be pushed against the metal and withdrawn when the position 76 of the vent is reaching the roller 68. For the usual gage of metal used for vents and for the usual size of vents, it has been found that the electric power may actuate the lathe for a period of about 6 to 10 seconds and may be switched off for a minimum period of 2 seconds. Although such a synchronization may be provided with a pedal for switching on and off the motor, it has been found that the hand 80 of the operator can synchronize the motion of the handle 70 on an on and off switching device of a known type.

Vents according to the present invention are usually made with a tubular member having a diameter from 4 to 7 inches and a height of about 12 to 15 inches. The shackle exceeds on each side of the tubular member for about 3 to 5 inches. The inclination of the vent usually varies between 15 and 30 degrees which corresponds to a tilt of 3 to 6 inches for a vent having a height of about 12 inches.

Vents according to the present invention are usually made of aluminium having a thickness of about 0.064 inch. Aluminium having such a thickness is relatively easy to spin and chase. However, for special requirements, sheets of copper or steel having a thickness of 0.090 inch are also used with using the same equipment. A spinning roller 44 or 68 having a diameter of about 5 inches performs satisfactorily.

For tilted vents having the above-mentioned dimensions, the length of the arm 38 is suitably dimensioned at about 24 inches which corresponds to the distance between the axle 40 and the outer tip of the roller 44.

Although the process of making tilted vents has been described by shifting the operation from a fast rotating lathe to a slow rotating lathe having a switch for further slowing down the speed of the lathe, one and the same lathe can be used if it can achieve all the required speeds.

It is pointed out that when the electric power is shut off for a short interval such as 2 seconds, the lathe does not come to a total stop. It has been found that regularity in the stop and go actuation of the motor allows a better productivity from experienced operators. The chasing operation is particularly successful when chasing is initiated at the moment the motor slows down. The chasing is also performed at the beginning of the acceleration and the chasing arm is retracted when the speed reaches its maximum. Such a sequence of speed is performed according to the rotation of the mold as explained above.

I claim:

1. A one piece seamless tilted vent made of one spinnable sheet of metal having a uniform tubular member and a flat shackle laterally extending from said tubular member at one end thereof, said shackle extending angularly relative to and in a continuous fashion from said tubular member.

2. A seamless tilted vent as recited in claim 1, wherein said sheet of metal is flat.

3. A seamless tilted vent as recited in claim 2, wherein said tubular member is cylindrical.

4. A seamless tilted vent as recited in claim 3, wherein said shackle has a minimum width of four inches.

5. A seamless tilted vent as recited in claim 4, wherein said sheet of metal is aluminum.

* * * * *